US005233802A

United States Patent [19]

Rogers

[11] Patent Number: 5,233,802

[45] Date of Patent: Aug. 10, 1993

[54] ADJUSTABLE DOOR FRAME

[75] Inventor: Harvey E. Rogers, Winnipeg, Canada

[73] Assignee: Greensteel Industries Ltd., Winnipeg, Canada

[21] Appl. No.: 849,820

[22] Filed: Mar. 11, 1992

Related U.S. Application Data

[63] Continuation of Ser. No. 519,758, May 7, 1990, abandoned.

[51] Int. Cl.[5] ..... E06B 1/04

[52] U.S. Cl. ..... 52/212; 52/217; 49/505

[58] Field of Search ..... 52/212, 213, 217; 49/505

[56] References Cited

U.S. PATENT DOCUMENTS

| | | | |
|---|---|---|---|
| 2,853,161 | 9/1958 | Mascari | 52/212 |
| 2,860,744 | 11/1958 | Mascari | 52/212 |
| 3,222,833 | 12/1965 | Woodrum | 49/505 X |
| 3,566,563 | 3/1971 | Ruff | 49/505 X |
| 3,571,995 | 3/1971 | Kasprzak | 52/212 |
| 3,571,996 | 3/1971 | Braswell | 49/505 X |
| 3,793,788 | 2/1974 | Collins | 52/217 X |
| 3,808,759 | 5/1974 | Carmichael | 52/212 |
| 3,906,671 | 9/1975 | Maldonado | 52/212 X |
| 4,128,977 | 12/1978 | Schubeis | 52/217 X |
| 4,395,855 | 8/1983 | Juker | 52/212 |
| 4,489,527 | 12/1984 | Haas | 52/212 X |
| 4,735,025 | 4/1988 | Day | 52/217 |
| 4,791,758 | 12/1988 | Bauer et al. | 49/505 |
| 4,813,204 | 3/1989 | Rentschler | 52/217 |
| 4,986,044 | 1/1991 | Funari | 52/217 X |

FOREIGN PATENT DOCUMENTS

| | | | |
|---|---|---|---|
| 940777 | 1/1974 | Canada . | |
| 1129253 | 8/1982 | Canada . | |
| 2841480 | 4/1980 | Fed. Rep. of Germany | 52/217 |

*Primary Examiner*—Carl D. Friedman
*Assistant Examiner*—Lan M. Mai
*Attorney, Agent, or Firm*—Murray E. Thrift; Stanley G. Ade; Adrian D. Battison

[57] ABSTRACT

An adjustable door frame has adjustable width jambs and header. Each of the frame elements consists of two elongated components held together with interengaging rails and channels on the two components. In use, the frame elements are adjusted to the desired width and are locked in place with self tapping screws through the rails and channels. This allows the elements to be installed in a door opening in the same way as a fixed width door frame and without the use of screws through the door casing.

11 Claims, 3 Drawing Sheets

ADJUSTABLE DOOR FRAME

This application is a continuation of application Ser. No. 519,758, filed May 7, 1990 now abandoned.

FIELD OF THE INVENTION

The present invention relates to door frames and more particularly to adjustable metal door frame assemblies.

BACKGROUND

In the installation of adjustable Width metal door frame assemblies, it is conventional to put in place the frame elements, e.g. the jambs and the header, to adjust them to the thickness of the wall and then to fasten them to the wall using screws through the door casing into the wall. This is a relatively complex procedure when compared with the installation of a fixed width door frame. In the resultant frame, the screws through the casing are aesthetically undesirable so it is common practice to install caps over the casing. This is a further step that has to be taken in the installation and also requires six additional pieces in the overall frame assembly.

It is an aim of the present invention to provide an improved adjustable door frame that is relatively simple both in construction and installation and that does not suffer from the aesthetic problems of the prior art. The invention is also Concerned with a method of installing the frame.

SUMMARY

According to one aspect of the present invention there is provided a door frame comprising adjustable width frame elements including two jambs and a header, each element comprising first and second elongate components with respective overlapping flanges, each element including stiffener means comprising rail means secured to the flange of the first component, channel means secured to the flange of the second component and engaging slideably over the rail means, the rail means and the flange of the first component being located between the channel means and the flange of the second component, the rail means and the channel means being oriented widthwise of the frame for relative movement thereof in response to adjustment of the width of the frame element, and means for securing the channel means to the rail means.

The term "adjustable width" is used as a general term including adjustable throat, that is the opening in the frame into which the wall fits, and adjustable jamb depth, that is the overall face-to-face dimension of the frame.

With this frame, the frame elements can be adjusted to the thickness of the wall before installation and then locked in an adjusted position, so that the frame can be installed in the same way as a conventional non-adjustable frame. No screws through the frame elements fastening them to the wall are necessary, so that covering caps are eliminated.

According to another aspect of the present invention there is provided a method of installing in a door opening in a wall an adjustable door frame of the type having adjustable width frame elements including two jambs and a header, each element having two elongate, overlapping components and stiffener mean associated with each element, the stiffener means comprising rail means secured to one component of each element and channel means secured to the other component of each element, the channel means being engageable over the rail means and moveable therealong with adjustment of the overlap of the components, said method comprising:

adjusting the width of each element to conform with the thickness of the wall at the door opening;

securing the channel means to the rail means thereby fixing the width of each element; and placing the frame elements in the door opening.

BRIEF DESCRIPTION OF THE DRAWINGS

In the accompanying drawings, which illustrate an exemplary embodiment of the present invention.

DETAILED DESCRIPTION

Figure 1:
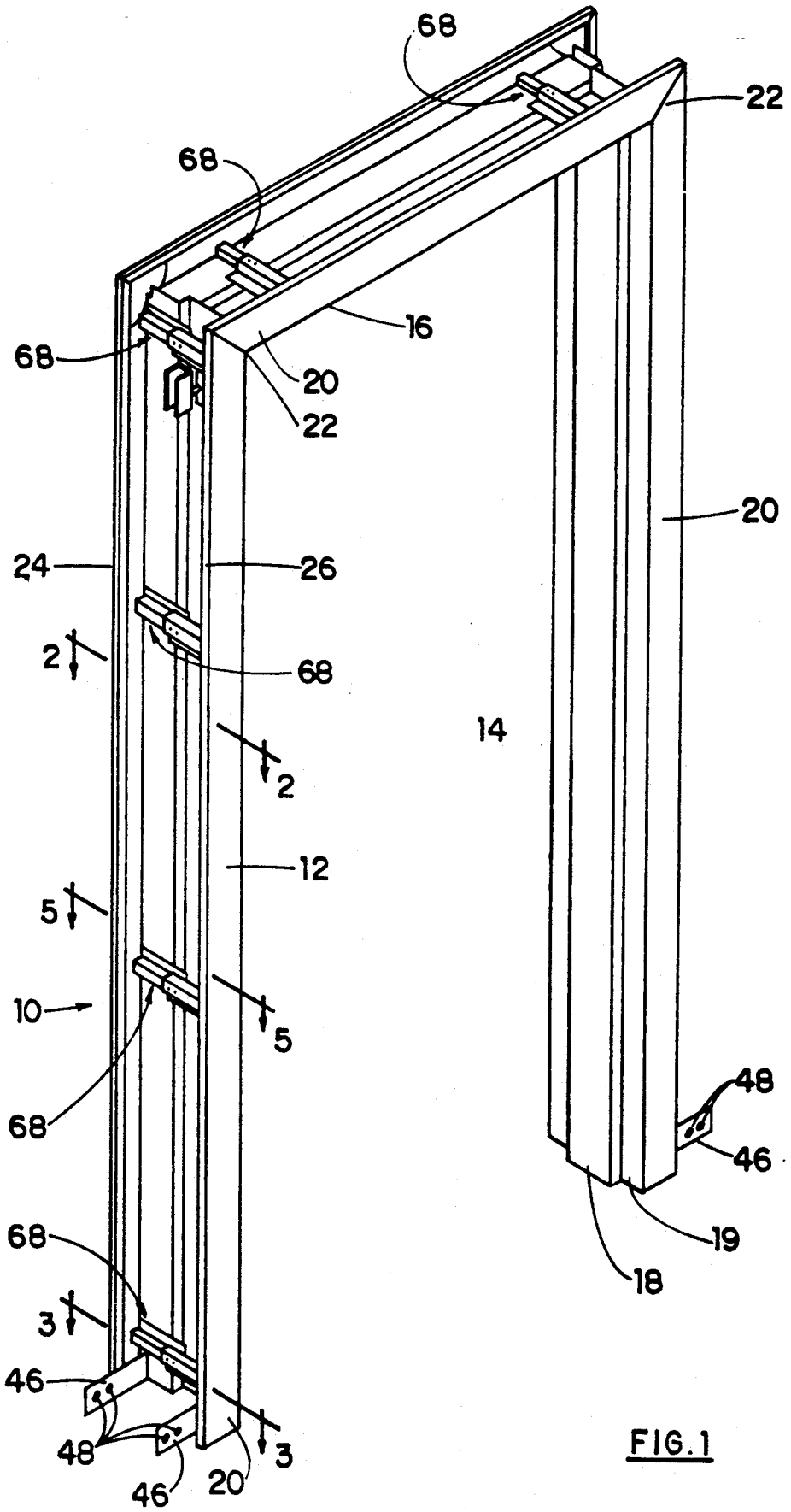
FIG. 1 is an isometric representation of a door frame according to the present invention.

Referring to the accompanying drawings, there is illustrated a door frame 10 that includes two jambs 12 and 14 and a header 16. One of the jambs will be a hinge jamb and the other a strike jamb. Which jamb is on which side will depend on whether the door is to be mounted right handed or left handed.

Each of the frame elements includes an integral door stop 18 providing a fixed depth door rebate 19. The frame elements provide a frame casing 20 that extends over the wall adjacent the door opening in which the frame is installed. At the upper corners of the frame, the casing components of the jambs and header meet at a mitred corner 22.

Figure 2:
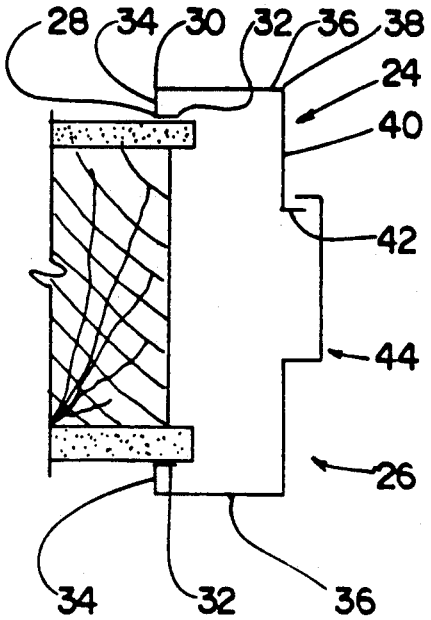
FIG. 2 is a section along the line 2—2 of FIG. 1.
Figure 3:
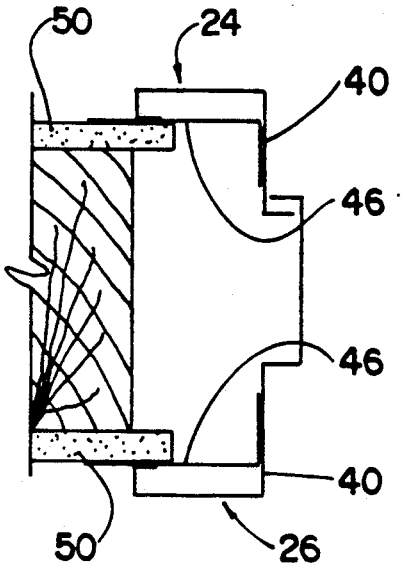
FIG. 3 is a section along the line 3—3 of FIG. 1.

As illustrated most particularly in FIGS. 2 and 3, each of the frame elements (that is each of the jambs and the header) includes two components 24 and 26. The component 24 is an elongate sheet metal element with two right angle bends 28 and 30 adjacent one of its edges providing two flanges 32 and 34 and a door casing flange 36 which ends at a right angle bend 38. This provides a flange 40 extending part way across the inside face of a door opening and terminating in an outwardly directed lip 42.

The component 26 is similarly shaped but includes an offset door stop section 44 in the form of a shallow channel into which the lip 42 projects.

As illustrated most particularly in FIG. 3, an L-shaped base clip 46 is spot welded to the flange 40 of each of the jamb components 24 and 26. The clip has two punched screw holes 48. When the frame is mounted in a door opening, the base clips extend over the face of the drywall or other paneling 50 and are held in place with screws through the screw holes 48 into the stud.

Figure 4:
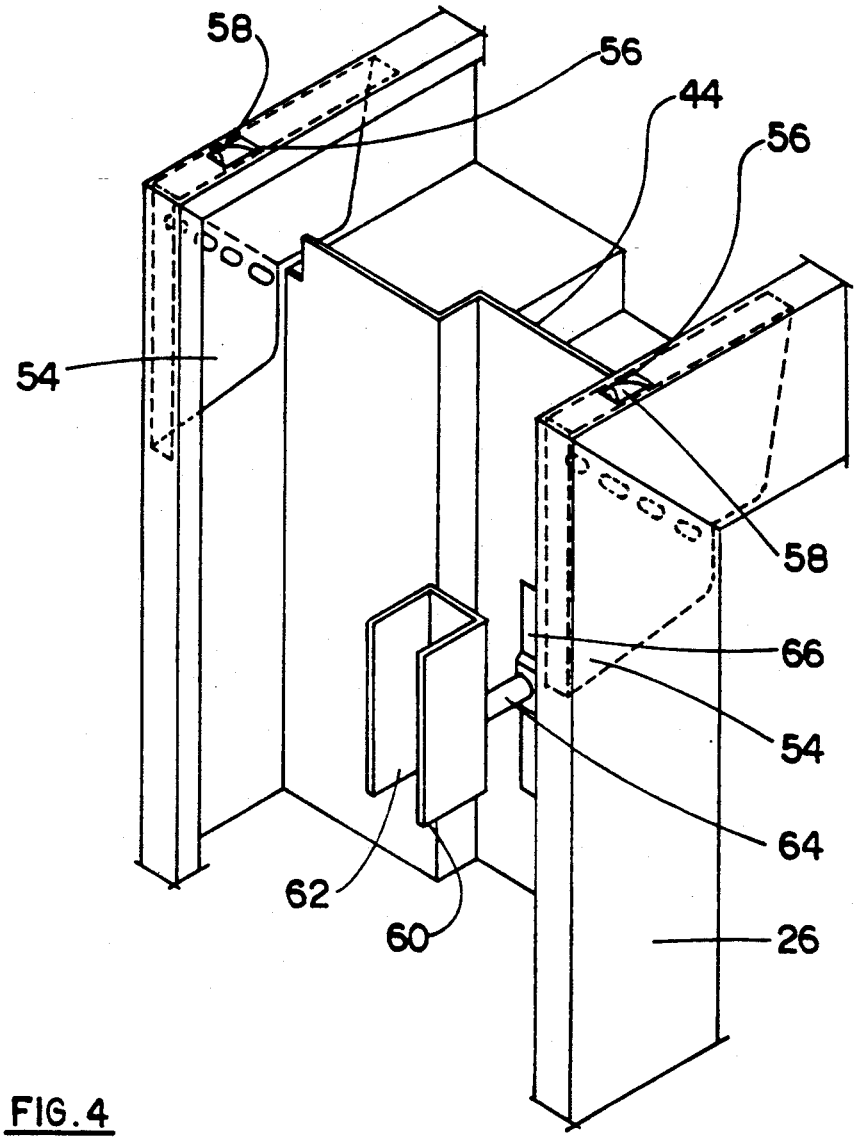
FIG. 4 is an isometric showing a corner detail of the frame.

As illustrated most particularly in FIG. 4, the upper corners of the frame are held together with sheet metal corner clips 54. Each clip is spot welded to a respective jamb component end-engages the end of an associated header component through a slot 56 in the flange 34 of the header and a projection 58 in the clip. This arrangement is more fully described in Canadian Patent 940,777 issued Jan. 29, 1974 to Pero Sales 1966 Limited.

FIG. 4 also illustrates a wall adjuster 60 that is fixed to the inside of the door stop 44 of the component 26 of each door jamb. The wall adjuster is located a short distance below the underside of the header in the completed frame. Each adjuster includes a short channel section 62 threaded onto a screw 64 that is rotatably mounted on the frame component by a bracket 66. An opening in the face of the door stop provides access to the screw so that it can be rotated to extend and retract the wall adjuster.

Figure 5:
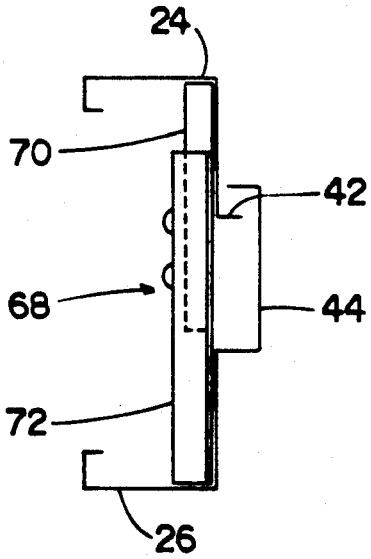
FIG. 5 is a section along the line 5—5 of FIG. 1.
Figure 7:
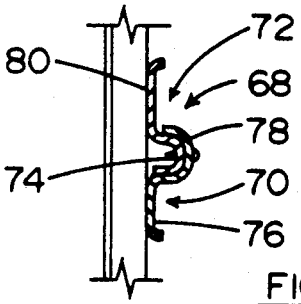
FIG. 7 is a section along the line 7—7 of FIG. 6.
Figure 6:
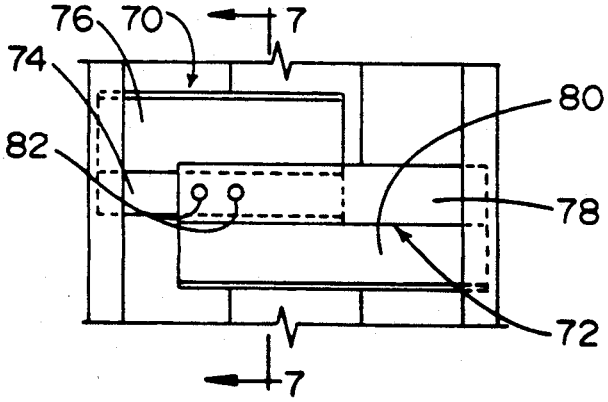
FIG. 6 is an elevation of an adjustable stiffener.

Each of the frame elements is equipped with stiffeners 68. These include four stiffeners for each jamb and two for the header. The construction of the stiffeners is illustrated most particularly in FIGS. 5, 6 and 7.

Each stiffener 68 includes a rail 70 fixed to the frame component 24 and a channel 72 fixed to the frame component 26. The rail 70 includes a channel section 74 and a flange 76 extending from one side of the channel section. The flange is spot welded to the flange 40 of the component 24 with the rail extending widthwise across the frame element. The channel 72 has a similar channel section 78 that fits slideably over the section 74. A flange 80 projects from the channel section 78 in a direction opposite the flange 76. Flange 80 is spot welded to the flange 40 of the component 26. With this arrangement, the rail 70 and the component 24 are captured between the channel 72 and the component 26. Engagement of the lip 42 on the component 24 with the end of the door stop 44 prevents the separation of the two components.

Two screw holes 82 are formed in the channel section 78 So that self tapping screws can be driven through those holes into the rail channel section 74 to fix the channel 72 and rail 70 together in an adjusted position corresponding to a particular wall width.

To install a door frame according to the invention, the thickness of the wall is measured around the door opening. The three frame elements are laid flat and adjusted so that the spacing between the flanges 32 corresponds to the wall thickness. Self tapping screws are then driven through the channel and rail of each stiffener so that the two components 24 and 26 of each frame element are fastened together. The wall adjuster screws are then rotated to bring the adjuster channels 62 up against the back of the jamb.

One of the jambs is positioned in the door opening and pushed tight against the stud. The header is then held at an angle to the installed jamb and the corner clips are engaged but not locked. The remaining jamb is then held at an angle to the free end of the header and its corner clips are engaged but not locked. The header and jamb assembly is then lifted into position in the door opening to close the mitres at the top corners. The mitres are looked by tappinq the top side of each jamb towards the header. The installed frame is then squared, the base clips are screwed to the studs on either side of the door frame and the wall adjusters are tightened to anchor the frame firmly to the wall and to ensure that it is properly aligned.

It will thus be seen that the installation technique is extremely simple and is much the same as that used in installing a comparable non-adjustable door frame using the corner clips described in the applicant's Canadian Patent 940,777. The resultant frame has no screws through the casing securing it to the wall so that the additional aesthetic covers used in the prior art are no longer necessary.

While one embodiment of the present invention has been described in the foregoing, it is to be understood that other embodiments are possible within the scope of the invention. The invention is to be considered limited solely by the scope of the appended claims.

I claim:

1. A door frame of the type comprising two jamb elements, a header element independent from the jamb elements and means for connecting the jamb elements and the header element into a substantially rigid frame, the frame being an adjustable width frame in which each element comprises first and second elongate components with respective overlapping flanges, each element including a guide means comprising plural elongate rails secured to an inner side of the flange of the first component, plural elongate channels secured to an inner side of the flange of the second component and engaging slidably over the respective rails for free sliding movement therealong, the rails and the channels being oriented widthwise of the frame for relative movement thereof in response to adjustment of the width of the frame element, and fastener elements extending through the respective channels to engage the associated rails securing the channels to the rails to prevent relative widthwise sliding movement of the channels and the rails whereby the width of each element may be fixed before installation of the frame.

2. A door frame according to claim 1 wherein the first and second components of each element are sheet metal sections.

3. A door frame according to claim 2 wherein the flange of each second component comprises and offset flange section providing a door stop.

4. A door frame according to claim 3 wherein the flange of each first component comprises a terminal lip projecting outwardly into the offset flange section of the associated second component.

5. A door frame according to claim 1 wherein each rail comprises a first sheet metal channel section with parallel first and second edges oriented widthwise of the frame and a rail mounting flange along the first edge, the rail mounting flange being secured to the first component.

6. A door frame according to claim 5 wherein each channel comprises a second sheet metal channel section with parallel first and second edges oriented widthwise of the frame and a channel mounting flange along the first edge of the second sheet metal channel section and projecting therefrom in a direction opposite the rail mounting flange of the associated rail, the mounting flange of the channel being secured to the second component, the rail mounting flange extending between the second component and the second edge of the channel.

7. A door frame according to claim 6 wherein the means for securing the channel to the rail comprise self tapping screws.

8. A door frame according to claim 7 including screw openings in the channel to receive the self tapping screws.

9. A door frame according to claim 1 including a base clip secured to each jamb element for attaching a bottom end of the element to a wall.

10. A door frame according to claim 9 including wall adjusters mounted on the second component of each jamb element adjacent an end thereof remote from the base clip, each wall adjuster including wall engagement means and means for urging the wall engagement means against a wall confronting the flanges of the jamb components.

11. A door frame comprising two jambs and a header, means for connecting the jambs to opposite ends of the header to from a substantially rigid frame, each jamb and the header comprising:

two elongate components with respective overlying flanges;

a plurality of stiffener means secured to inner sides of the overlapping flanges of the two components for maintaining the flanges parallel to one another, each stiffener means comprising:

a transversely oriented channel secured to one of the components;

a transversely oriented rail secured to the other of the components, the rail being engaged slidably in the channel; and fastener elements extending through the respective channels into the associated rails securing the channel to the rail to prevent sliding movement of the rail along the channel, the fastener means being accessible solely from the inner side of the component.

* * * * *